US007926916B2

(12) United States Patent
Schmidt et al.

(10) Patent No.: US 7,926,916 B2
(45) Date of Patent: Apr. 19, 2011

(54) ADHESIVE JOINT WITH AN INK TRAP AND METHOD

(75) Inventors: Charles G. Schmidt, Corvallis, OR (US); Joseph R. Elliot, Corvallis, OR (US); James E. Clark, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/062,217

(22) Filed: Jan. 31, 2002

(65) Prior Publication Data

US 2003/0142172 A1 Jul. 31, 2003

(51) Int. Cl.
*B41J 2/05* (2006.01)

(52) U.S. Cl. ..... 347/63

(58) Field of Classification Search ..... 347/20, 347/47, 50, 44, 63, 64, 87
See application file for complete search history.

(56) References Cited

U.S. PATENT DOCUMENTS

| | | | | |
|---|---|---|---|---|
| 4,994,825 | A * | 2/1991 | Saito et al. | 347/63 |
| 5,736,998 | A * | 4/1998 | Caren et al. | 347/45 |
| 5,755,909 | A * | 5/1998 | Gailus | 156/229 |
| 5,852,460 | A | 12/1998 | Schaeffer et al. | |
| 5,874,971 | A * | 2/1999 | Nishioka et al. | 347/20 |
| 5,924,198 | A | 7/1999 | Swanson et al. | 29/890.1 |
| 5,933,163 | A | 8/1999 | Koizumi et al. | |
| 6,079,810 | A * | 6/2000 | Davis | 347/20 |
| 6,244,696 | B1 | 6/2001 | Tran et al. | 347/87 |
| 6,257,703 | B1 * | 7/2001 | Hirosawa et al. | 347/50 |
| 6,334,672 | B1 * | 1/2002 | Matsui et al. | 347/70 |
| 6,688,718 | B1 * | 2/2004 | Steinfield et al. | 347/18 |

FOREIGN PATENT DOCUMENTS

| | | |
|---|---|---|
| EP | 0 705 698 | 7/1999 |
| JP | 195693 | 8/1995 |

* cited by examiner

*Primary Examiner* — Anh T. N. Vo

(57) ABSTRACT

An adhesive joint with an ink trap is provided. The joint may be employed in a cartridge for an inkjet printer. The cartridge includes a headland region attached to a printhead assembly by an adhesive layer. The adhesive joint between the headland region and the printhead assembly include notches for retaining additional adhesive in order to reduce degradation of adhesive due to ink penetration. A method of assembling the printer cartridge to include an ink trap in the adhesive joint is also provided.

16 Claims, 14 Drawing Sheets

ADHESIVE JOINT WITH AN INK TRAP AND METHOD

BACKGROUND

The present invention generally relates to adhesive joints and, more particularly, to adhesive joints configured to resist degradation in a chemically-hostile environment.

Adhesive joints are widely used in industry to join components. In some applications, an additional requirement placed upon an adhesive joint is that it be resistant to degradation in a chemically-hostile environment. An example of a chemically-hostile environment is the ink storage and delivery system of an inkjet printer.

Inkjet printers have gained wide acceptance. Inkjet printers produce high quality print, are compact and portable, and print quickly and quietly because only ink strikes the paper. An inkjet printer forms a printed image by printing a pattern of individual dots at particular locations of an array defined for the printing medium. The locations are conveniently visualized as being small dots in a rectilinear array. The locations are sometimes referred to as "dot locations", "dot positions", or "pixels". Thus, the printing operation can be viewed as the filling of a pattern of dot locations with dots of ink.

Inkjet printers print dots by ejecting very small drops of ink onto the print medium and typically include a movable carriage that supports one or more printheads, each having ink ejecting nozzles. The carriage traverses over the surface of the print medium, and the nozzles are controlled to eject drops of ink at appropriate times pursuant to command of a microcomputer or other controller, wherein the timing and position for the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed nozzles attached to a printhead substrate that incorporates an array of firing chambers which receive liquid ink from the ink reservoir. Each chamber has a thin-film resistor, known as an inkjet firing chamber resistor, located opposite the nozzle so ink can collect between it and the nozzle. The firing of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

The printhead may include a flexible circuit tape having conductive traces formed thereon and have nozzles or orifices formed by Excimer laser ablation, for example. The resulting flexible circuit having orifices and conductive traces may then have mounted on it a substrate containing heating elements associated with each of the orifices. The conductive traces formed on the back surface of the flexible circuit are then connected to the electrodes on the substrate and provide energization signals for the heating elements. A barrier layer, which may be a separate layer or formed in the nozzle member itself, includes vaporization chambers, surrounding each orifice, and ink flow channels which provide fluid communication between an ink reservoir and the vaporization chambers.

Typically, the integrated nozzle and flexible circuit or tape circuit is sealed to a print cartridge. A nozzle member containing an array of orifices has a substrate, having heater elements formed thereon, affixed to a back surface of the flexible circuit. Each orifice in the flexible circuit is associated with a single heating element formed on the substrate. The back surface of the flexible circuit extends beyond the outer edges of the substrate. Ink is supplied from an ink reservoir to the orifices by a fluid channel within a barrier layer between the flexible circuit and the substrate. In either embodiment, the flexible circuit is adhesively sealed with respect to the print cartridge body by forming an ink seal, circumscribing the substrate, between the back surface of the flexible circuit and the body.

However, it has been determined that adhesive loses its adhesive qualities due to exposure to the ink. Over time ink concentration in the adhesive increases. Degradation in joint strength has been found to occur in direct proportion to the concentration of ink absorbed by the adhesive. Prior solutions to protecting adhesive joints from the effects of the ink include: providing protecting coatings that cover the joint; using adhesives that are more resistant to the effects of the ink; providing designs that lengthen the diffusion distance of the ink into the adhesive by modifying the joint design; and modifying the joint design to reduce stress. All of these solutions are expensive to implement and/or provide less than satisfactory results.

Thus, there remains a need to increase the life of adhesive joints in ink jet cartridges, and other applications, that may be implemented simply and cost effectively without requiring additional materials or changes in the existing materials.

SUMMARY OF THE INVENTION

In one embodiment of the present invention an adhesive joint is provided. The joint has improved resistance to degradation resulting from ink penetration and may include an adhesive layer located between two opposing surfaces. The adhesive layer includes an ink trap for diluting the concentration of ink penetrated into the adhesive. Preferably, the ink trap is formed by providing a notch in at least one of the two opposing surfaces.

The adhesive joint may be employed, for example, in a cartridge for an inkjet printer. The cartridge may include a headland region attached to a printhead assembly by an adhesive layer. The adhesive joint between the headland region and the printhead assembly may include notches for retaining additional adhesive in order to reduce degradation of adhesive due to ink penetration. A method of assembling components, such as printer cartridges, to include an ink trap in the adhesive joint is also provided.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

FIG. 15(*b*) is a cross-sectional view of an adhesive joint according to another embodiment of the present invention.

DETAILED DESCRIPTION

Figure 15A:
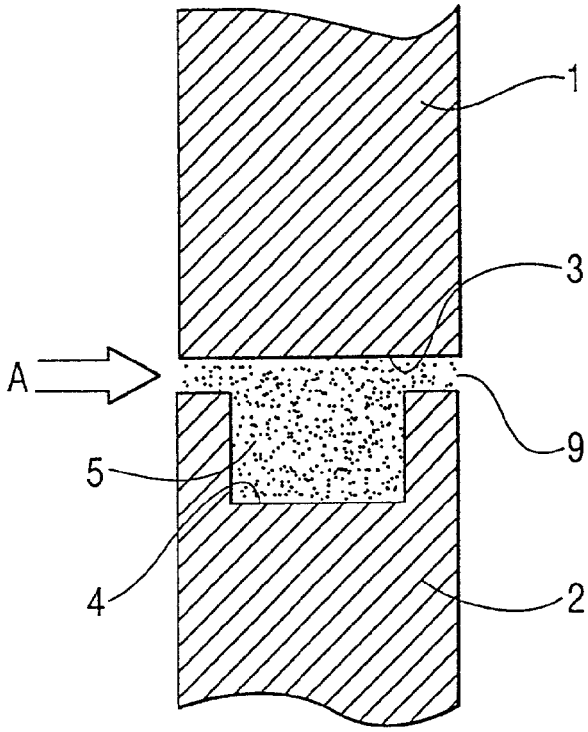
FIG. 15(*a*) is a cross-sectional view of an adhesive joint according to an embodiment of the present invention.
Figure 15B:
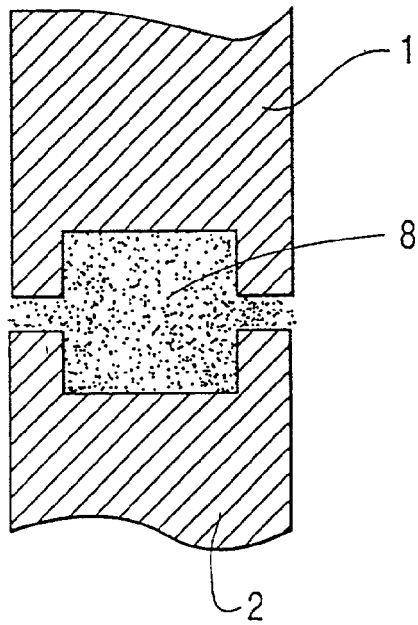

An embodiment of the present invention is disclosed in FIG. 15. Two components 1, 2 are connected together by an adhesive 9. An adhesive joint is formed between two opposing surfaces 3, 4 of the components. When exposed to ink, the adhesive joint provides improved resistance to degradation of the adhesive due to ink penetration. As shown in FIG. 15, the joint preferably includes notch 5 in one of the opposing surfaces. The notch 5 allows a larger volume of adhesive to serve as an ink trap and dilute the concentration of ink in the adhesive. The ink may penetrate the joint from the side as shown by the arrow A in FIG. 15(*a*). Thus, the distance between the surfaces is smallest adjacent the ink.

While FIG. 15(*a*) discloses a notch in one of the two opposing surfaces the present invention includes many alternatives such as the structure shown in FIG. (15*b*), for example. As shown in FIG. 15(*b*) each opposing surface includes a notch to thereby form an ink trap 8. The shape of notch as shown in the Figures includes squared corners however any surface indentation increasing the volume of adhesive between the joined surfaces is within the scope of the present invention.

Figure 1:
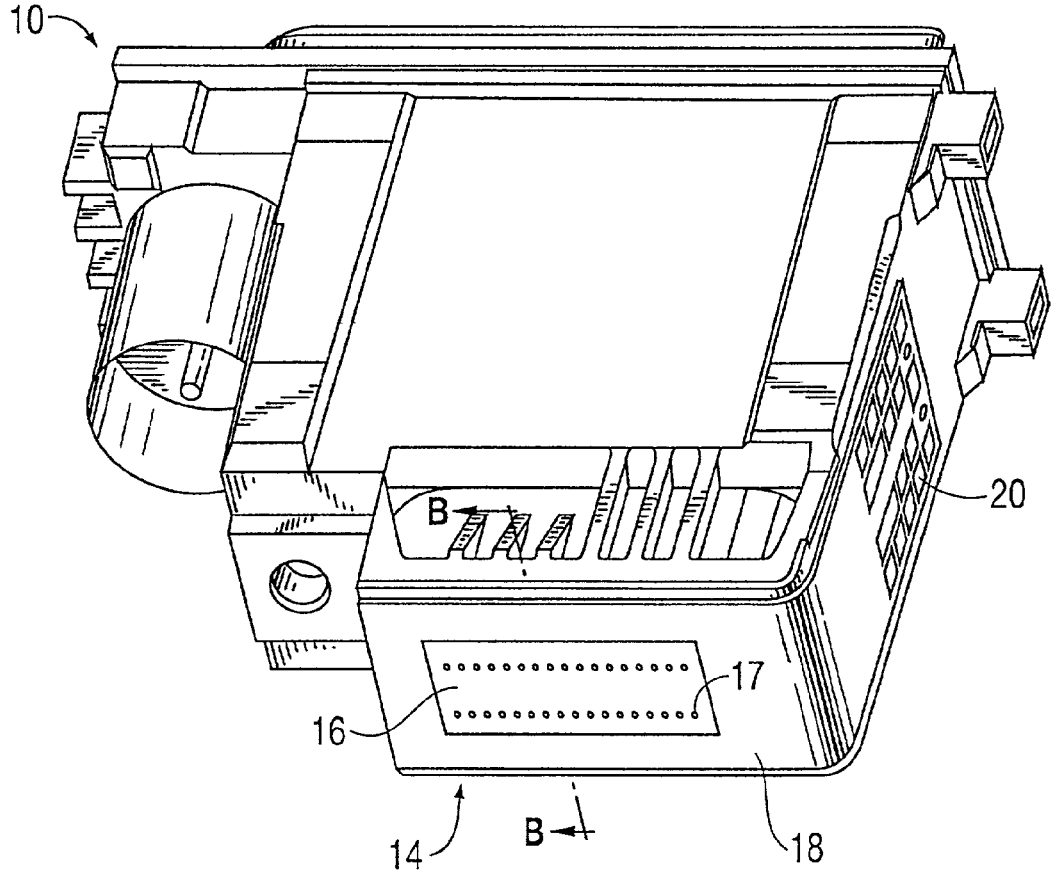
FIG. 1 is a perspective view of an inkjet print cartridge according to one embodiment of the present invention.

An inkjet printer cartridge 10 incorporating a printhead according to a particular exemplary embodiment of the present invention is shown in FIG. 1. The inkjet print cartridge 10 includes an internal ink reservoir and a printhead 14, where the printhead 14 is formed using Tape Automated Bonding (TAB). The printhead 14 includes a nozzle member 16 comprising two parallel columns of offset holes or orifices 17 formed in a flexible polymer circuit 18 by, for example, laser ablation. The circuit 18 typically may be formed in Kapton tape.

Figure 2A:
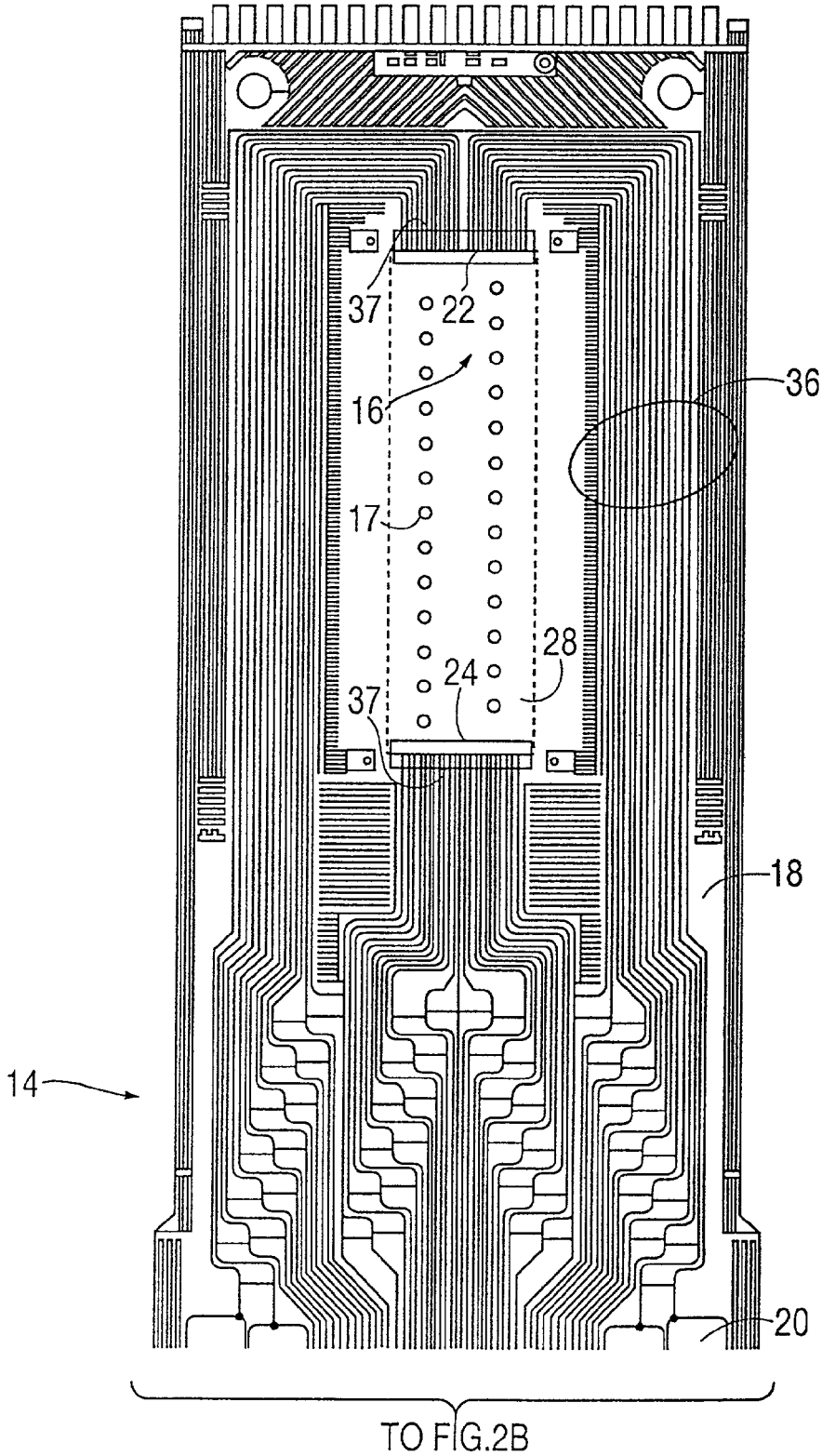
FIG. 2 is a plan view of the front surface of a Tape Automated Bonding (TAB) printhead assembly removed from a print cartridge according to one embodiment of the present invention.
Figure 2B:
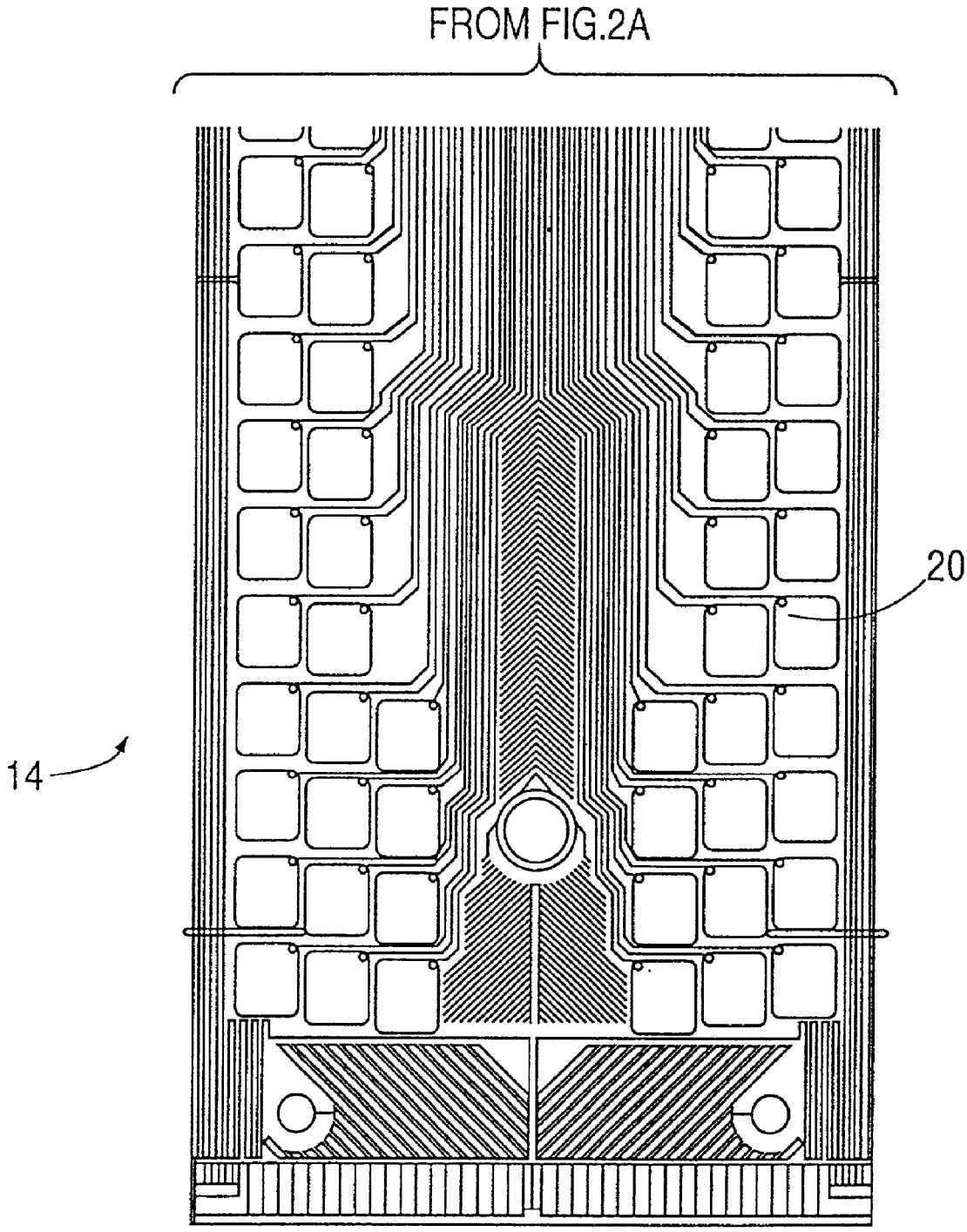

As shown in FIG. 2, the flexible circuit 18 provides for the routing of conductive traces 36 which are connected at one end to electrodes on a substrate (described below) and on the other end to contact pads 20 in the exemplary embodiment. The print cartridge 10 is designed to be installed in a printer so that the contact pads 20 on the front surface of the flexible circuit 18 contact printer electrodes providing externally generated energization signals to the printhead.

FIG. 2 shows a front view of a printhead assembly 14 removed from a print cartridge 10. Printhead assembly 14 has affixed to the back of the flexible circuit 18 a silicon substrate 28 containing a plurality of individually energizable thin film resistors. Each resistor is located generally behind a single orifice 17 and acts as an ohmic heater when selectively energized by one or more pulses applied sequentially or simultaneously to one or more of the contact pads 20. Windows 22 and 24 extend through the flexible circuit 18 and are used to facilitate bonding of the other ends of the conductive traces 36 to electrodes on the silicon substrate.

The orifices 17 and conductive traces 36 may be of any size, number, and pattern, and the various figures are designed to simply and clearly show the features of the invention. The relative dimensions of the various features have been greatly adjusted for the sake of clarity.

Figure 3:
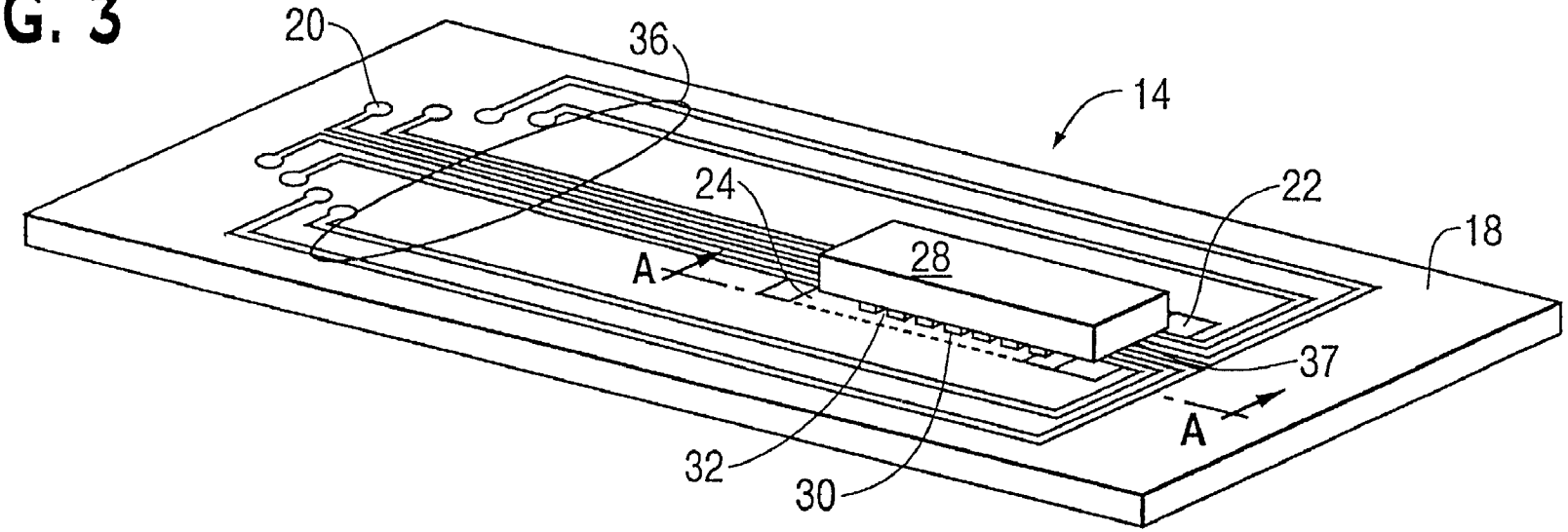
FIG. 3 is a highly simplified perspective view of the back surface of the TAB head assembly of FIG. 2 with a silicon substrate mounted thereon and the conductive leads attached to the substrate according to one embodiment of the present invention.

FIG. 3 shows a simplified view of the back surface of a printhead assembly 14 according to the exemplary embodiment. The back surface of the flexible circuit 18 includes conductive traces 36 formed thereon using a conventional photolithographic etching and/or plating process, for example. The silicon die or substrate 28 is mounted to the back of the flexible circuit 18 with the nozzles or orifices 17 aligned with an ink vaporization chamber 32. The conductive traces 36 are terminated by leads 37 that are bonded to electrodes 40 on the substrate 28 and by contact pads 20 designed to interconnect with a printer.

One edge of a barrier layer 30 containing vaporization chambers 32 formed on the substrate 28 is shown in FIG. 3. Shown along the edge of the barrier layer 30 are the entrances to the vaporization chambers 32 which receive ink from an internal ink reservoir within the print cartridge 10. The windows 22 and 24 allow access to the leads 37 of the conductive traces 36 and the substrate electrodes 40 to facilitate bonding of the leads to the electrodes.

Figure 4:
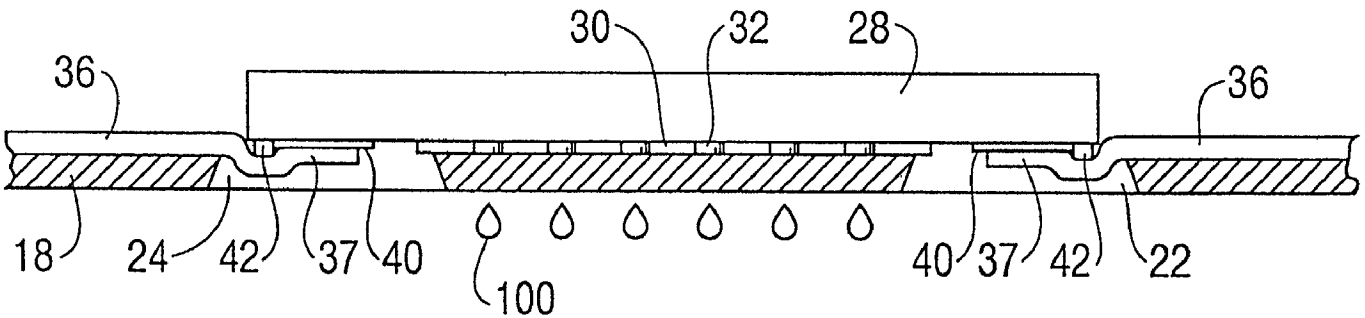
FIG. 4 is a side elevational view in cross-section taken along line A-A in FIG. 3 illustrating the attachment of conductive leads to electrodes on the silicon substrate according to one embodiment of the present invention.

FIG. 4 illustrates the connection of the ends of the conductive traces 36 to the electrodes 40 formed on the substrate 28. A portion 42 of the barrier layer 30 is used to insulate the leads 37 of the conductive traces 36 from the substrate 28. Also shown is a side view of the flexible circuit 18, the barrier layer 30, the windows 22 and 24, and the entrances of the ink vaporization chambers 32. As shown in FIG. 4, during operation droplets of ink 100 are ejected from orifice holes (not shown in the figure) associated with each of the ink vaporization chambers 32.

Figure 5:
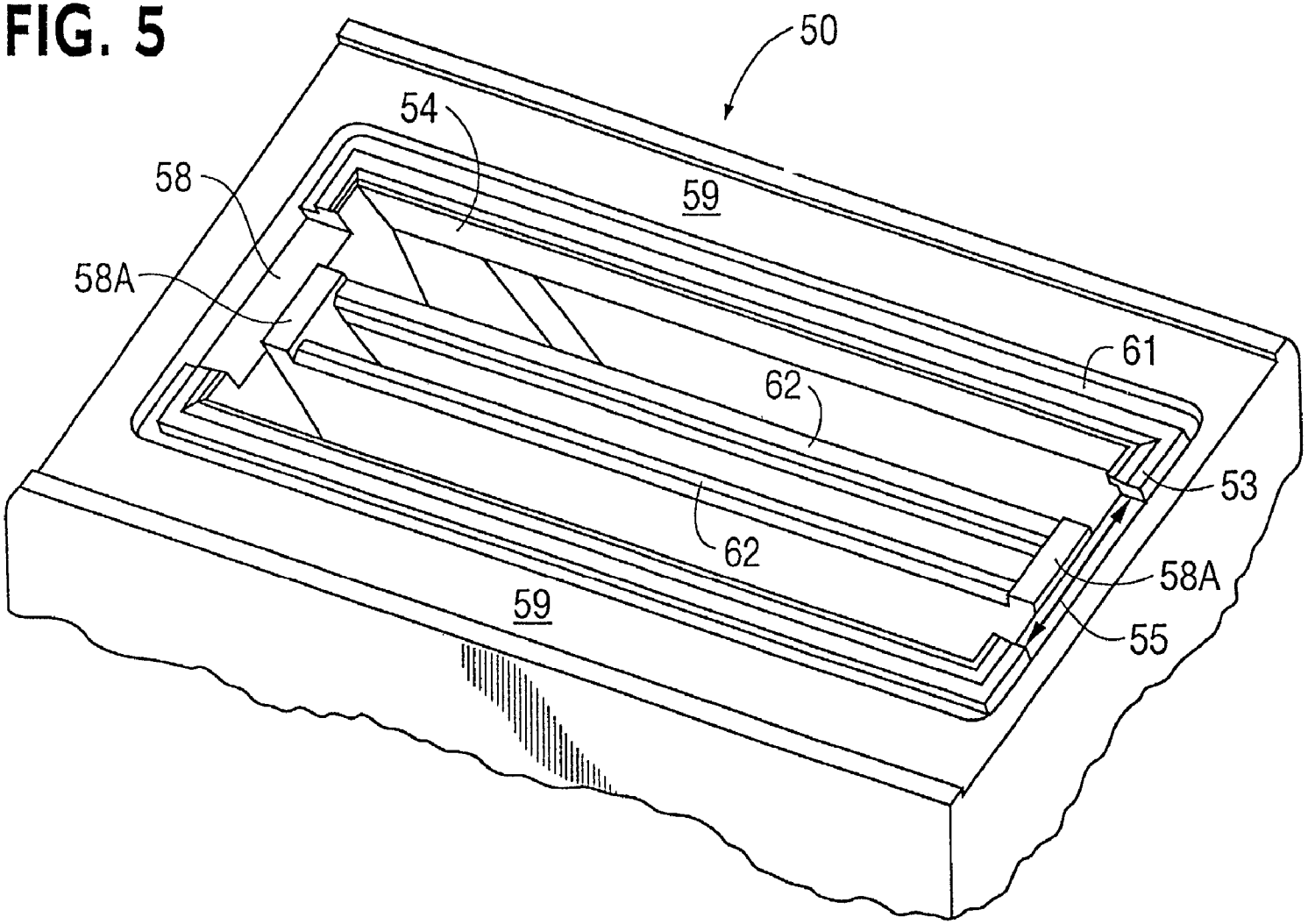
FIG. 5 is a perspective view of the headland area of the inkjet print cartridge of FIG. 1 according to one embodiment of the present invention.
Figure 6:
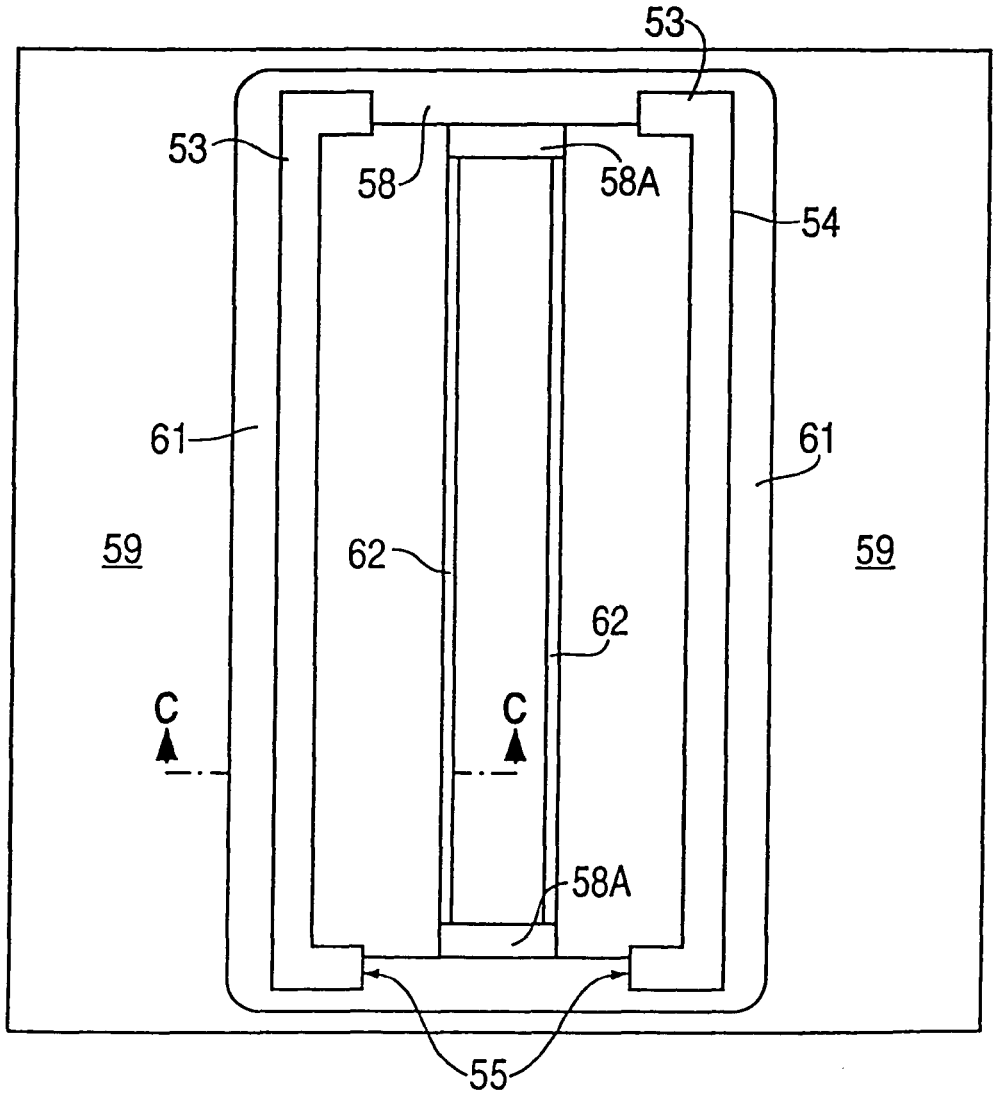
FIG. 6 is a top plan view of the headland area of the inkjet print cartridge of FIG. 1 according to one embodiment of the present invention.
Figure 7:
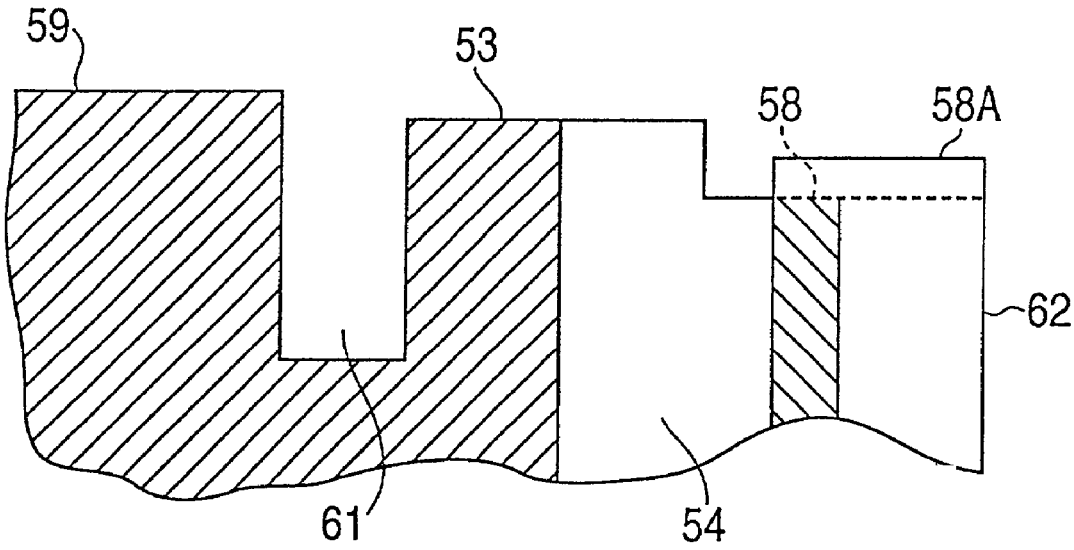
FIG. 7 is a side elevational view in cross-section taken along line C-C in FIG. 6 illustrating the configuration of the adhesive support surface, inner wall, gutter and of the headland design according to one embodiment of the present invention.

As shown in FIGS. 5-7, a headland area 50 of print cartridge 10 of the exemplary embodiment includes an inner raised wall 54, an adhesive support surface 53 on the inner raised wall, openings 55 in the inner raised wall 54, a surface 58, a raised substrate support surface 58A, a flat top surface 59 and a gutter 61. A pair of walls 62 are provided to define the ink flow path 88 (shown in FIG. 9) to the back of the substrate 28.

Figure 8:
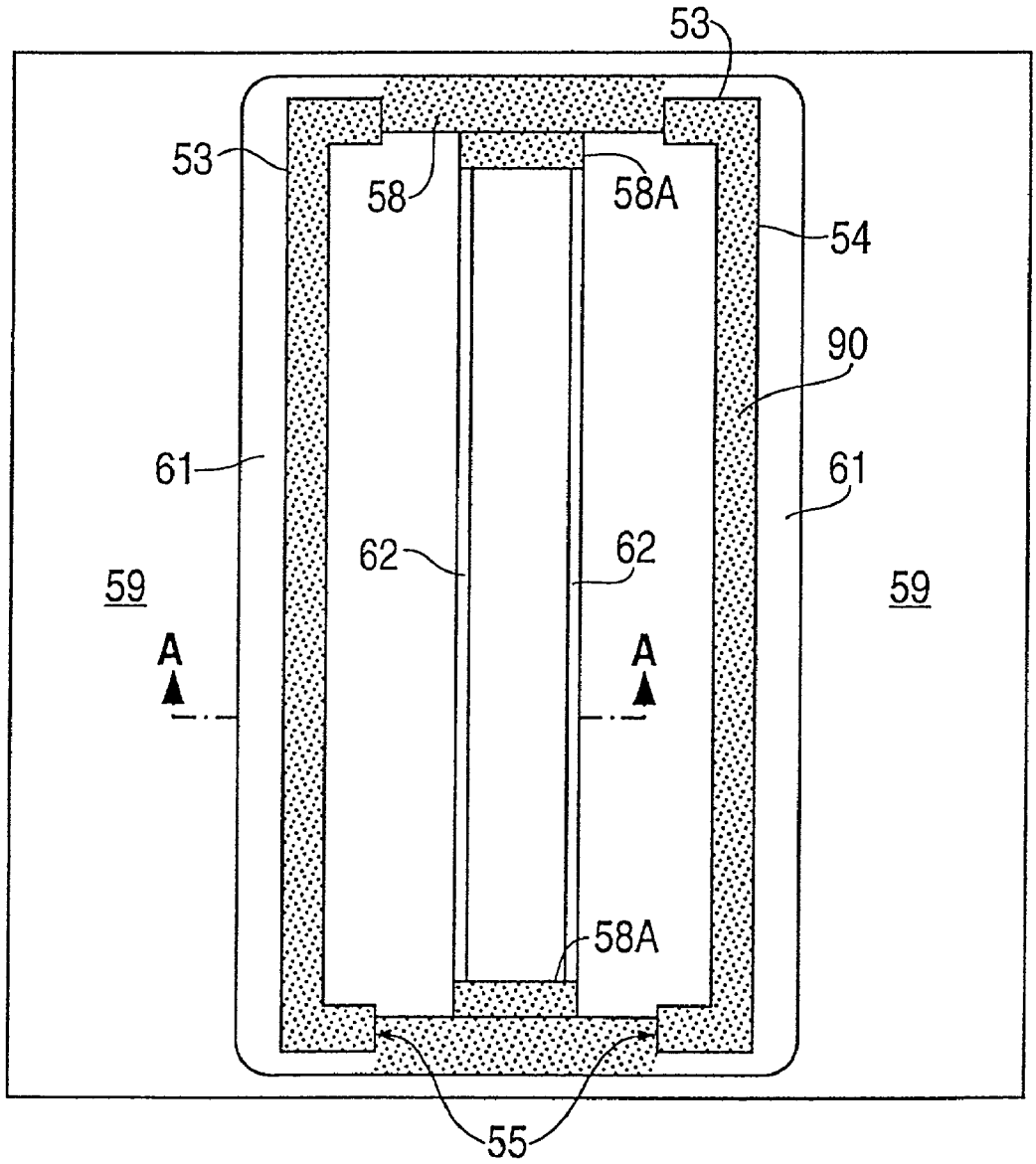
FIG. 8 is a top plan view of the headland area showing generally the location of the adhesive bead prior to placing the TAB head assembly on the headland area according to one embodiment of the present invention.
Figure 11:
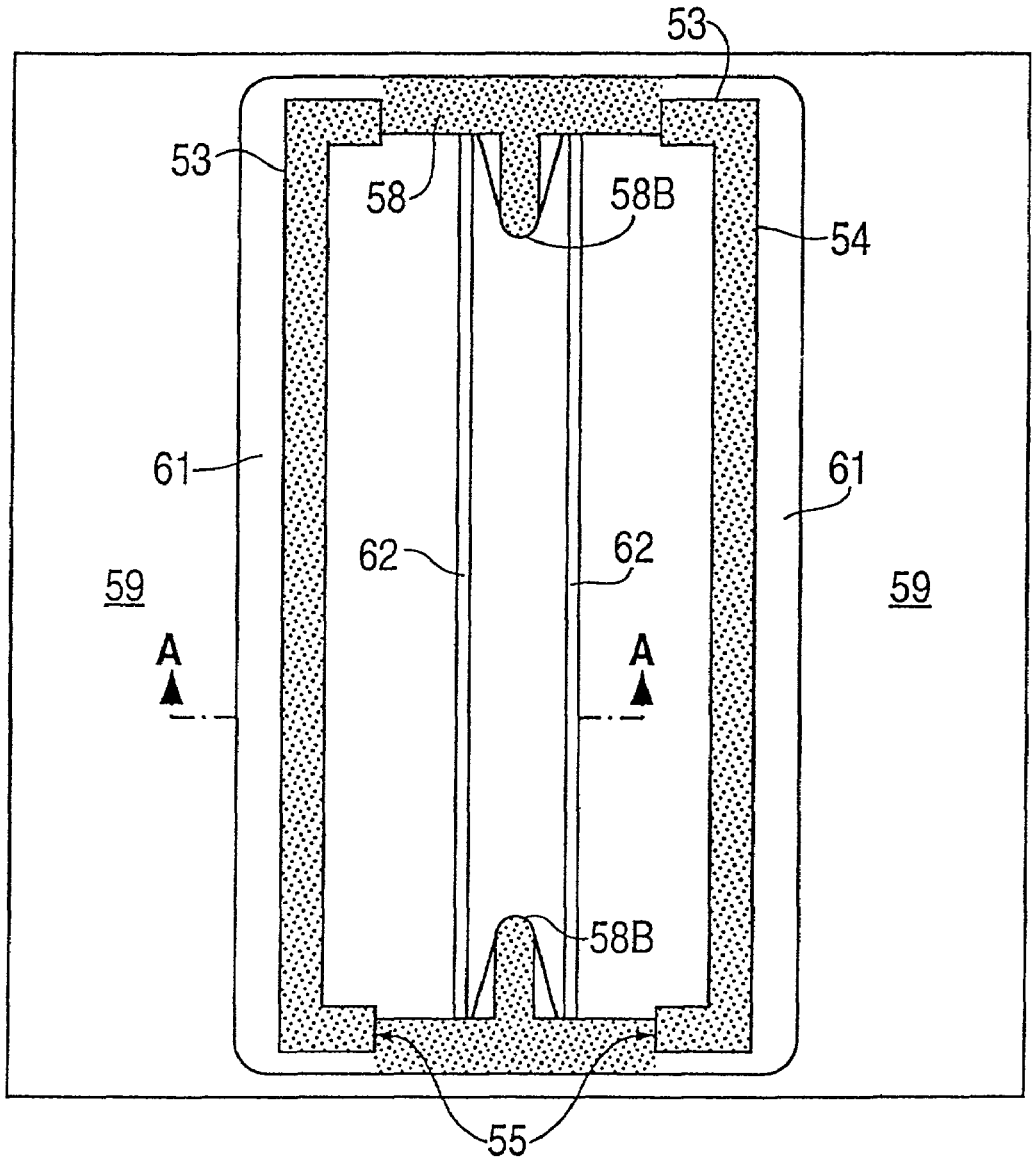
FIG. 11 is a top plan view of the headland area of an alternative embodiment of the present invention showing generally the location of the adhesive bead prior to placing the TAB head assembly on the headland area.

FIG. 8 is top plan view showing generally the location of the dispensed adhesive 90 (shown in FIGS. 8 and 9) along the adhesive support surface 53 of inner raised wall 54, on elevated substrate support surface 58A and across surface 58 in the wall openings 55 of the inner raised wall 54. As an alternative to the generally rectangular substrate support surface 58A shown in FIG. 8, the cartridge 10 may include a tongue shaped support surface 58B as shown in FIG. 11. As shown in FIG. 5, the present invention includes a headland portion 50 in which the substrate support surfaces are coplanar or elevated. An example of coplanar surfaces is shown in FIG. 11, where the tongue shaped portion 58B is coplanar with the support surface 58. It should be noted that the embodiment shown in FIG. 8 may be modified to in this same manner.

As shown in FIG. 8, the adhesive 90 circumscribes the substrate 28 when the printhead assembly 14 is properly positioned and pressed down on the headland 50. The adhesive 90 forms a structural attachment between the printhead assembly 14 and the inner raised wall 54 and the support surface 58 of the print cartridge 10. The adhesive also provides a liquid seal between the above-described circumscribed location and the back of the printhead assembly 14 when printhead assembly 14 is affixed to the headland portion 50 of the cartridge.

Figure 9:
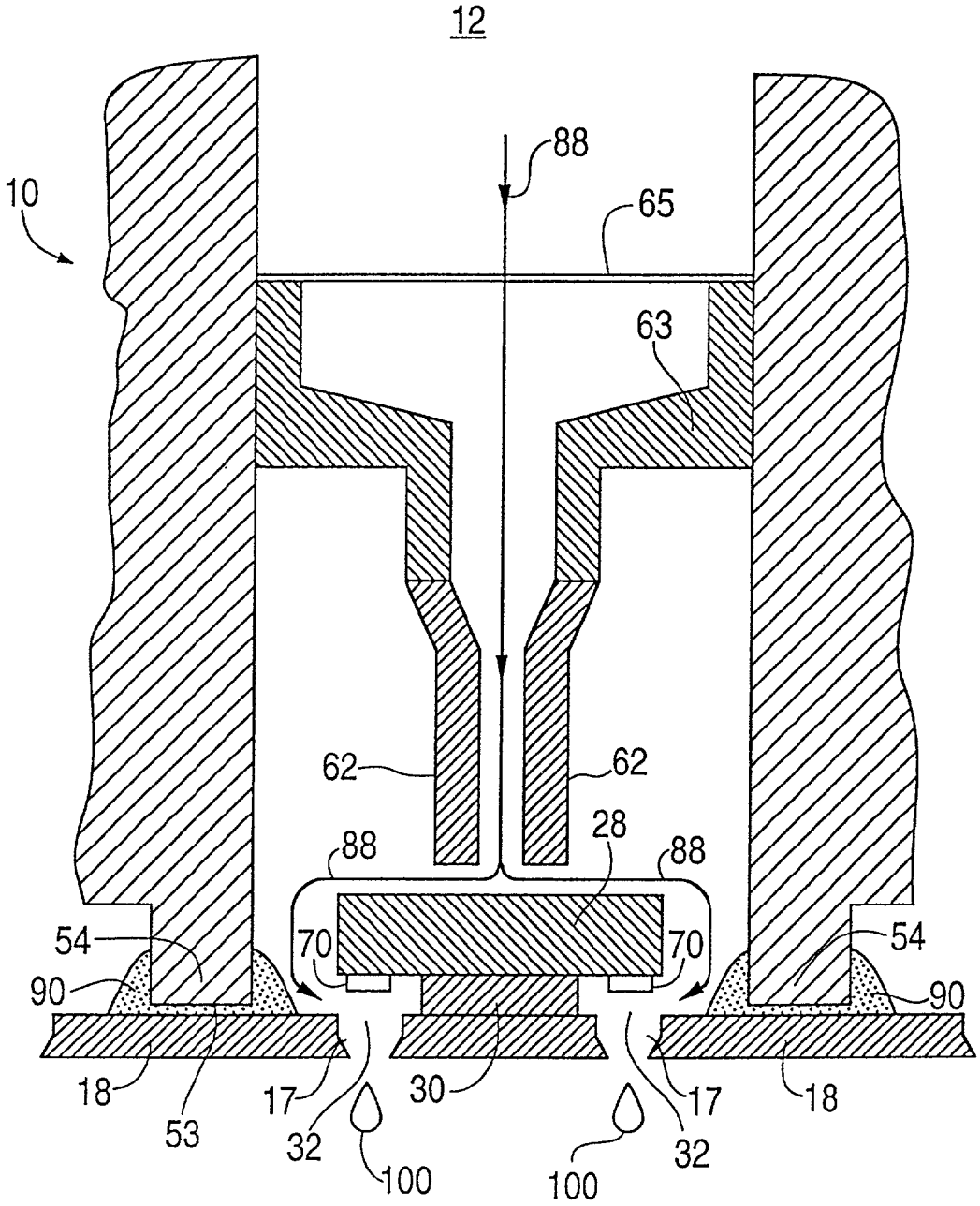
FIG. 9 is a partial schematic cross-sectional schematic view taken along line B-B of FIG. 1 showing portion of the print cartridge in the proximity to the TAB head assembly according to one embodiment of the present invention.

FIG. 9 shows the vaporization chambers 32, thin film resistors 70, and orifices 17 after the barrier layer 30 and substrate 28 have been secured to the back of the flexible circuit 18 and the flexible circuit 18 is secured to the inner raised wall 54 of the print cartridge 10 by adhesive 90. In operation, ink flows from reservoir 12 around the edge of the substrate 28, and into vaporization chamber 32, as shown by the arrow 88. A barrier layer 30, the flexible circuit 18 and the substrate 28 define the ink vaporization chambers 32. Upon energization of the thin film resistor 70, a thin layer of the adjacent ink is superheated, causing a droplet of ink 100 to be ejected through the orifice 17. The vaporization chamber 32 is then refilled with ink by capillary action. As shown in FIG. 9, an adhesive seal 90 is provided for attaching the inner raised wall 54 to the flexible tape or circuit 18.

The plastic print cartridge 10 of the exemplary embodiment includes a body formed such that an ink conduit directs the flow of ink 88 from a reservoir 12 within the print cartridge 10 towards the back of the substrate and through a narrow gap that exists between the back surface of substrate 28 and the walls 62. The flow of ink 88 is along the back surface of substrate 28, around the edge of substrate 28 and into the vaporization chambers 32. The filter carrier 63 and the walls 62 direct the flow of ink 88.

Figure 10:
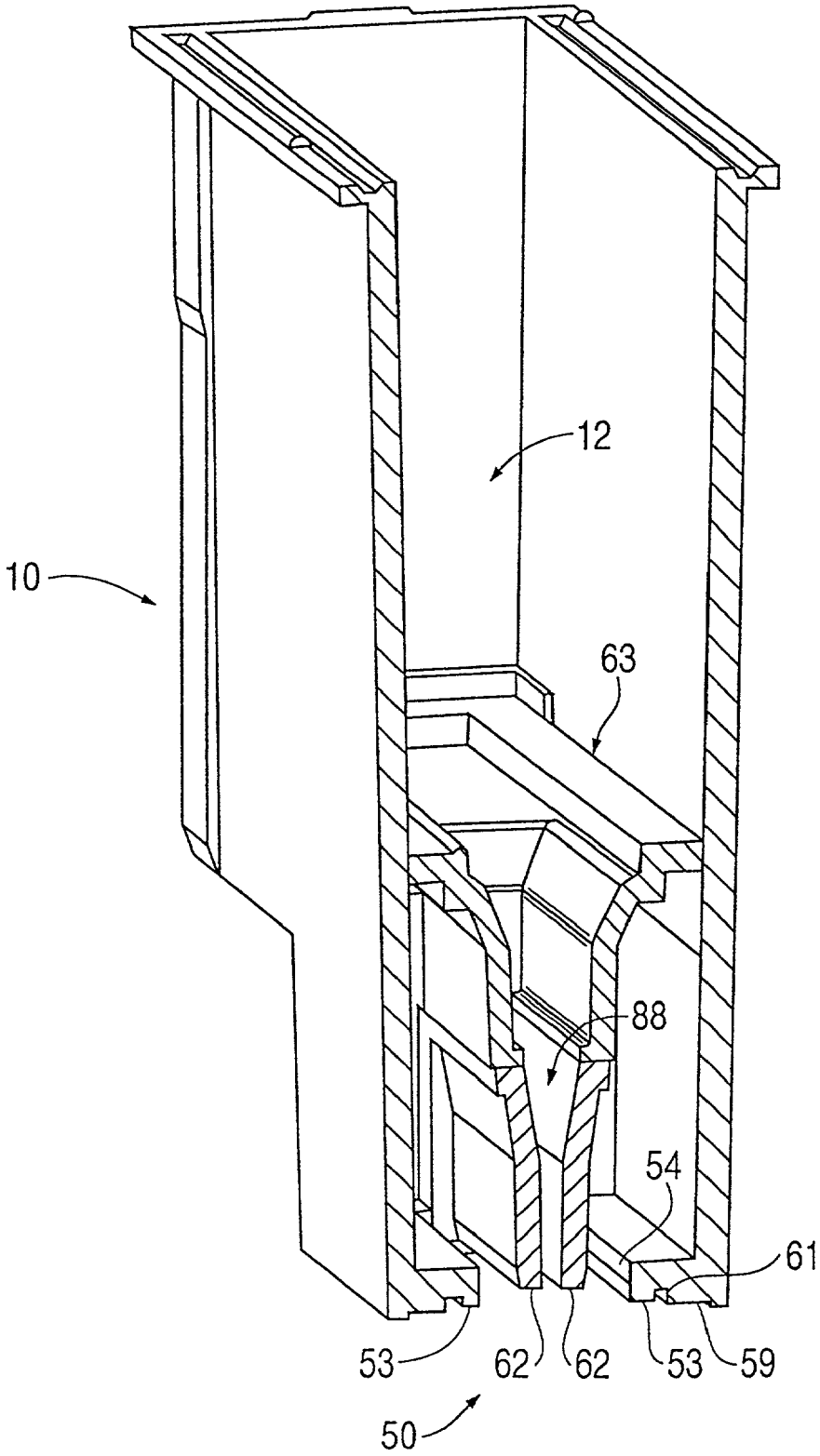
FIG. 10 is a cross-sectional, perspective view along line B-B of FIG. 1 with the TAB head assembly removed illustrating the internal structure of a inkjet print cartridge and the headland 50 area according to one embodiment of the present invention.

Referring to FIG. 10, the internal structure of the headland area 50 of the printer cartridge 10 is shown in FIG. 10. The cartridge 10 includes an ink reservoir region 12 for containing ink, a filter carrier 63 with its filter screen 65 removed, walls 62, the ink flow path 88 defined by the filter carrier 63 and walls 62 leading to the back surface of the substrate 28. Also shown is a portion of the headland area 50 including inner raised wall 54, adhesive support surface 53 on the inner raised wall, flat top surface 59 and gutter 61.

As described above, traditional adhesive connections or joints between the headland portion 50 and the printhead assembly 14 are subject to reduced lifetimes due to ink penetration into the adhesive. The present invention addresses this problem by providing an ink trap 52, 56, 57 in the area of the joint. The provision of an ink trap reduces the rate of increase of ink concentration in the adhesive and, therefore, reduces the amount of degradation of adhesion between the components.

According to the present invention the adhesive joint includes two regions, a thin adhesive region and a thick adhesive region or trap. The thin adhesive region is located immediately adjacent to the ink is as thin as possible in order to reduce the area of adhesive exposed to the ink and thereby limit the amount of ink that may diffuse into the adhesive. At the same time, the ink trap is provided to increase the amount of adhesive available to absorb diffused ink and thereby reduce the concentration of ink in the adhesive. The ink trap is a region of increased thickness in the adhesive layer between the headland portion 50 and printhead assembly 14.

As described above, the headland region 50 of the cartridge is connected to the printhead assembly 14 with at least two joints. First, the tape circuit 18 is connected to the support surface 53 on the inner raised wall. Second, the ends of the substrate 28 are connected to the support surfaces 58A, 58B. The substrate is also connected to the support surface 58. The support surfaces 58A, 58B may be elevated relative to the adjacent support surface 58 as shown in FIGS. 8 and 12 or coplanar with the adjacent support surface 58 as shown in FIGS. 11 and 13.

Figure 12:
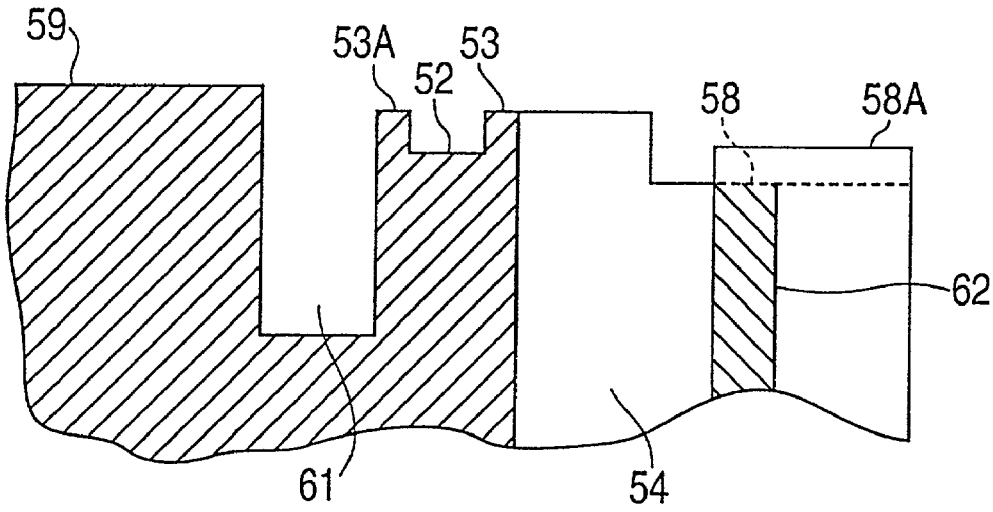
FIG. 12 is a side elevational view in cross-section taken along line C-C in FIG. 6 illustrating the configuration of the adhesive support surface, inner wall, gutter and of the headland design of an alternative embodiment of the present invention.
Figure 13:
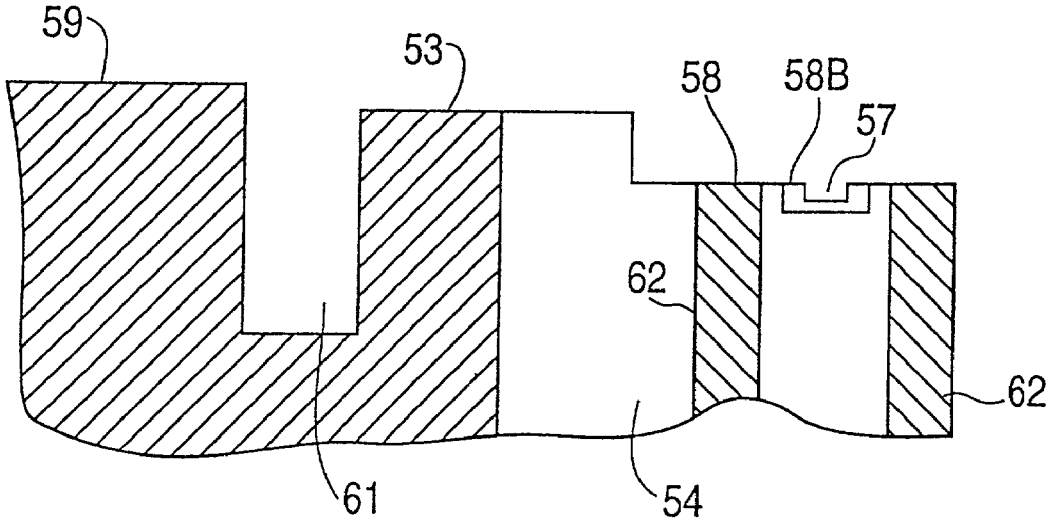
FIG. 13 is a side elevational view in cross-section taken along line A-A in FIG. 8 illustrating the configuration of the adhesive support surface, inner wall, gutter and of the headland design of an alternative embodiment of the present invention.
Figure 14:
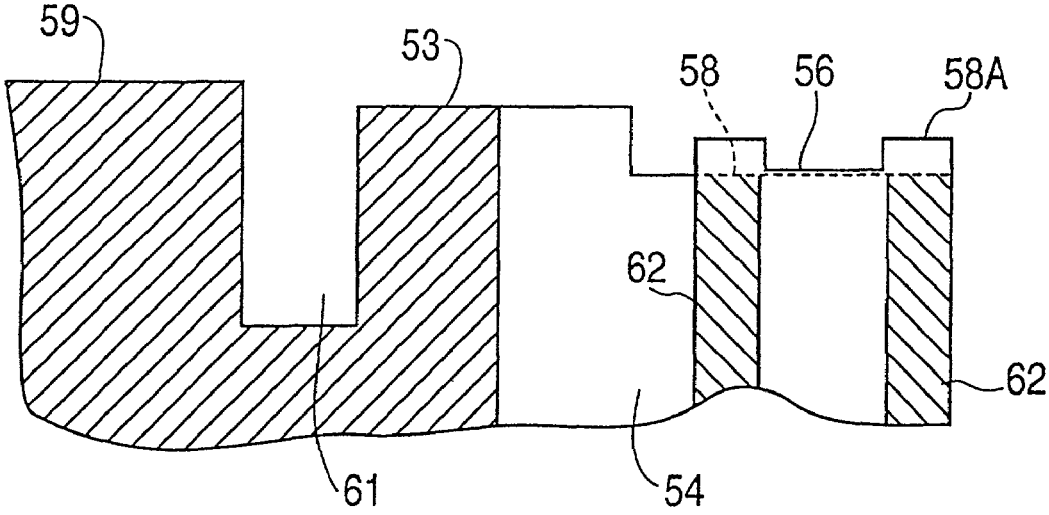
FIG. 14 is a side elevational view in cross-section taken along line A-A in FIG. 11 illustrating the configuration of the adhesive support surface, inner wall, gutter and of the headland design of an alternative embodiment of the present invention.

As shown in FIG. 12, the support surface 53 may include a notch or ink trap 52 for containing adhesive. The trap 52 serves to create the thick adhesive region discussed above, while the adjacent areas of the support surface 53A serve to create the thin adhesive region. Similarly, as shown in FIG. 13, the tongue shaped support surface 58B may include a notch or ink trap 57. The areas of the support surface 58B adjacent to the ink trap 57 are coated with a thin adhesive layer while the notch or trap 57 contains a thick adhesive layer. The generally rectangular shaped support surface 58A, may also include a notch or ink trap 56 and adjacent areas 58A for creating the thick adhesive region bounded by thin adhesive regions. The ink trap and support surfaces are formed so that the thickness of the adhesive near the ink is at a minimum.

Modeling suggests that the provision of an ink trap may increase the life of the adhesive joint by a factor of approximately eight. The modeling was based on the following assumptions: that adhesive strength is a linear function of ink or ink components that have diffused into the adhesive; that the ink concentration in the adhesive is at saturation when failure occurs; that the increase in contact area between the adhesive and the headland portion due to the presence of the ink trap is of no significant benefit; that bulk diffusion and not interface diffusion of ink or ink components is the primary mechanism of ink penetration into the adhesive; and, that residual stresses play no role in the failure. If one or more of these assumptions are not correct, the ink trap may still be of benefit, however, the magnitude of the benefit may be different than the factor of eight mentioned above.

The adhesive joint of the present invention may also be effectively applied in assembly of other ink storage and delivery components, and in other chemically-hostile environments. The present invention may be utilized in any application where exposure to chemicals causes degradation of adhesive joints.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A print cartridge for an inkjet printer comprising:

a printhead assembly including a substrate and a flexible circuit;

a headland portion connected to the printhead assembly by an adhesive;

wherein the headland portion includes an inner raised wall surrounded by a gutter and a wall opening therein, the wall opening including a first surface, the headland portion including a second surface positioned generally within the wall opening, the second surface being elevated with respect to the first surface;

wherein the second surface includes an ink trap for retaining adhesive to thereby reduce the concentration of diffused ink in the adhesive, and wherein the cartridge is configured to eject ink in a first direction, wherein the inner raised wall projects above the first surface in the first direction and wherein the second surface projects above the first surface in the first direction.

2. The cartridge of claim 1, wherein the ink trap comprises a notch in the second surface.

3. The cartridge of claim 1, wherein the first surface is T-shaped.

4. The cartridge of claim 1, wherein the first surface comprises a floor of the wall opening.

5. The cartridge of claim 1, wherein the first surface extends in a first plane and wherein the second surface extends in a second different plane.

6. The cartridge of claim 1, wherein the second surface extends on opposite sides of the ink trap.

7. A printer cartridge for an inkjet printer comprising:

a flexible circuit having a plurality of ink orifices and electrical leads;

a substrate containing a plurality of heating elements and associated ink vaporization chambers, the substrate having electrodes to which the electrical leads are bonded, the substrate mounted on a back surface of the flexible circuit, each heating element being located proximate to an associated ink orifice, the back surface of the flexible circuit extending over two or more outer edges of the substrate;

a headland portion located proximate to the back surface of the flexible circuit and including an inner raised wall circumscribing the substrate, the inner raised wall surrounded by a gutter having a wall opening therein, the wall opening including a first surface, the headland portion including a second surface for supporting the substrate, the second surface being positioned generally within the wall opening and elevated with respect to the first surface;

an adhesive layer positioned between the back surface of the flexible circuit and the headland portion to affix the flexible circuit to the headland portion, the adhesive layer located on the inner raised wall and on the second surface; and an ink trap located on the second surface to reduce the concentration of the ink in the adhesive layer; and wherein the ink trap comprises a notch in the second surface, and wherein the cartridge is configured to eject ink in a first direction, wherein the inner raised wall projects above the first surface in the first direction and wherein the second surface projects above the first surface in the first direction.

8. The printer cartridge of claim 7, wherein the first surface is tongue shaped.

9. The printer cartridge of claim 7, wherein the adhesive layer includes thick regions and a thin region, the thick regions being located in the ink trap.

10. The cartridge of claim 7, wherein the first surface comprises a floor of the wall opening.

11. The cartridge of claim 7, wherein the first surface extends in a first plane and wherein the second surface extends in a second different plane.

12. The cartridge of claim 7, wherein the second surface extends on opposite sides of the ink trap.

13. A method of assembling an inkjet printer cartridge comprising the steps of:

(a) providing a printhead assembly including a substrate and a circuit;

(b) providing a headland portion of the printer cartridge, wherein the headland portion includes an inner raised wall surrounded by a gutter and a wall opening therein, the wall opening including a first surface, the provided headland portion including a second surface positioned generally within the wall opening and elevated with respect to the first surface;

(c) providing a notch in the second surface;

(d) bonding the printhead assembly to the second surface using an adhesive, wherein a portion of the adhesive is located in the notch so that the concentration of the ink that subsequently diffuses into the adhesive is diluted by the portion of the adhesive located in the notch, and wherein the cartridge is configured to eject ink in a first direction, wherein the inner raised wall projects above the first surface in the first direction and wherein the second surface projects above the first surface in the first direction.

14. The method of claim 13, wherein the first surface comprises a floor of the wall opening.

15. The method of claim 13, wherein the first surface extends in a first plane and wherein the second surface extends in a second different plane.

16. The method of claim 13, wherein the second surface extends on opposite sides of the notch.

* * * * *